United States Patent [19]

Crepin

[11] 4,211,378

[45] Jul. 8, 1980

[54] STEERING ARRANGEMENT FOR PROJECTILES OF THE MISSILE KIND, AND PROJECTILES FITTED WITH THIS ARRANGEMENT

[75] Inventor: Roger Crepin, Paris, France

[73] Assignee: Thomson-Brandt, Paris, France

[21] Appl. No.: 894,209

[22] Filed: Apr. 6, 1978

[30] Foreign Application Priority Data

Apr. 8, 1977 [FR] France ..... 77 10755

[51] Int. Cl.[2] ..... F42B 15/18

[52] U.S. Cl. ..... 244/3.22

[58] Field of Search ..... 244/3.1, 3.21, 3.22

[56] References Cited

U.S. PATENT DOCUMENTS

| | | | |
|---|---|---|---|
| 2,584,127 | 2/1952 | Harcum et al. | 244/3.21 |
| 2,726,510 | 12/1955 | Goddard | 244/3.22 |
| 2,816,721 | 12/1957 | Taylor | 244/3.1 |
| 2,822,755 | 2/1958 | Edwards et al. | 244/3.22 |
| 3,045,596 | 7/1962 | Rae | 244/3.22 |
| 3,588,003 | 6/1971 | Johnston | 244/3.22 |
| 3,599,899 | 8/1971 | McCullough | 244/3.22 |
| 3,655,148 | 4/1972 | McCullough | 244/3.22 |
| 4,078,495 | 3/1978 | Ledden, Jr. | 244/3.22 |

*Primary Examiner*—David H. Brown

*Attorney, Agent, or Firm*—Edwin E. Greigg

[57] ABSTRACT

A steering arrangement for missile type projectiles. A source of steering propulsion which is accommodated in the vicinity of the center of gravity of the missile comprises two gas generators which are positioned symmetrically on either side of the center of gravity a system being provided to switch or divert the gases to the exterior of the missile in at least two directions which are transverse to the projectile and to its axis.

The arrangement according to the invention considerably improves the reliability and effectiveness with which the projectile is steered.

7 Claims, 17 Drawing Figures

STEERING ARRANGEMENT FOR PROJECTILES OF THE MISSILE KIND, AND PROJECTILES FITTED WITH THIS ARRANGEMENT

BACKGROUND OF THE INVENTION

The present invention relates to a steering arrangement for missile type projectiles and more particularly artillery projectiles, rockets fired from aircraft or the ground and other related kinds of missiles.

Projectiles of this kind are steered aerodynamically by virtue of an angle of incidence, which they are caused to assume, the projectiles generally having fixed wings which allow them to gain support from the atmosphere in order to maneuver.

The angle of incidence assumed by the projectile is the result of a moment obtained by setting ailerons situated at the front or the rear of the said projectile or by deflecting the jet propelling the projectile.

In all cases, aerodynamic steering has the particular disadvantage of being restricted by the delay with which the missile assumes an angle of incidence after an order has been given by the steering system. In practice, this delay or time-constant has proved impossible to reduce to less than approximately 0.2 seconds, which entails obvious disadvantages for projectiles travelling at very high speed such as missiles. Consequently, the performance which can be expected from such a projectile in a guidance loop is limited.

OBJECT AND SUMMARY OF THE INVENTION

The principal object of the present invention is to overcome these disadvantages by providing a steering arrangement which is capable of altering the trajectory of the projectile by generating a transverse force required for the maneuver which is not the aerodynamic lifting force referred to above, and to do so without it being necessary to alter the angle of incidence of the projectile in order to cause the said transverse force to appear. The projectile, which no longer derives its support from the air, is thus equally capable of maneuvering outside the atmosphere.

To this end, the steering arrangement according to the invention is characterized in that it comprises: a source of energy which supplies a flow of gas, means for creating a force transverse to the longitudinal axis of the projectile, and change-over means to alter the orientation of the said force.

In a preferred embodiment, the steering arrangement is housed close to the center of gravity of the missile or vector concerned.

If the steering arrangement is produced in such a way that the transverse force is applied to the center of gravity of the vector, it will be appreciated that the vector is able, because of this, to change its trajectory under the prompting of this force without its angle of incidence being altered. Consequently, the delay or time-constant mentioned above which changes of incidence involve is completely eliminated, which constitutes a very important advantage of the arrangement according to the invention.

In a preferred embodiment, the steering arrangement includes two gas generators which are positioned symmetrically on either side of the center of gravity coaxially with the missile and communicating with each other, while means are provided to distribute, that is to say to switch, the gases to the exterior of the missile in at least two directions which are symmetrical about the longitudinal axis of the missile.

Under these conditions, the outflow of gas from the two generators does not shift the center of gravity of the vector since the reduction in the mass of the propellant is the same on both sides of the center of gravity. Thus, this arrangement makes an effective contribution to preserving the equilibrium of the missile while its steering arrangement is operating.

In one possible embodiment of the arrangement according to the invention, the gas generators are formed by two propellant spaces which are connected together by at least one longitudinal passage and a nozzle throat for the outflow of the combustion gases is arranged in the vicinity of the said passage in the wall of one of the spaces coaxially with the missile and communicates with at least two ducts for expelling the gases in two directions which are symmetrical about the longitudinal axis of the missile, a switching system being in addition mounted between the two spaces to divert the combustion gases into one or the other of the said directions.

The response time of the system for switching the gases, and thus the response time for a thrust force to appear, is of the order of a few milliseconds. It is extremely short when compared with the response time for the appearance of an aerodynamic reaction force in prior art systems, which ranges between 0.2 and more than 0.5 seconds. Cylinders of compressed gas may also be used as generators but although these also have a very short response time, their energy/volume ratio is not so good.

In accordance with a feature of the invention, the switching system comprises a vane which is mounted to rotate about a shaft perpendicular to the longitudinal axis of the missile, this vane being approximately triangular in outline and having its apex engaged in the nozzle throat, the sides of the vane running from the apex defining, in conjunction with the walls of the said nozzle, ducts for expelling the gases to the exterior of the missile transversely thereto, this vane being associated with a control arrangement which is capable of causing the vane to swing to one side or the other about its shaft in order to channel the gases into one or another expulsion duct.

Other features and advantages of the invention will become apparent in the course of the following detailed description. In the accompanying drawings, which are given by way of non-limiting example, are shown a number of embodiments of the arrangement according to the invention.

DESCRIPTION OF THE PREFERRED EMBODIMENTS

In the embodiment shown in FIGS. 1 to 5, the steering arrangement to which the invention relates is fitted to a projectile formed by a missile 1. In accordance with the invention, the steering arrangement 2 comprises means capable of generating a force transverse to the longitudinal axis XX of the missile 1, and a change-over system to alter the orientation of the said force.

Figure 1:
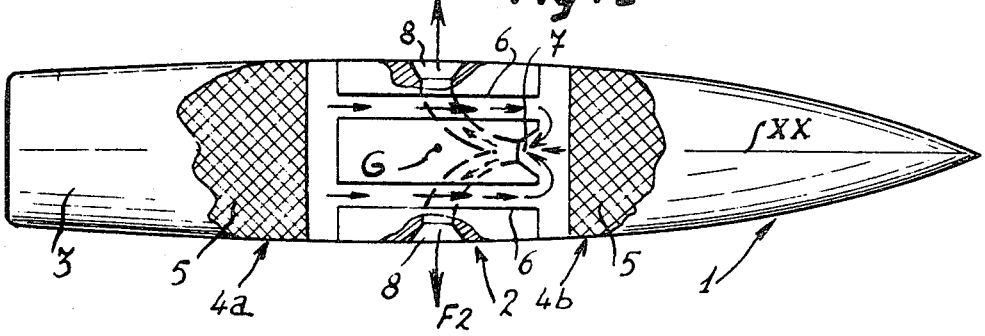
FIG. 1 is a partly cut-away schematic view in longitudinal elevation of a projectile fitted with a steering arrangement according to the invention.
Figure 3:
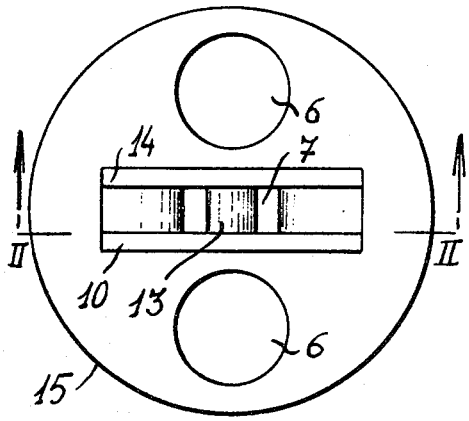
FIG. 3 is a plan view, looking in the direction K indicated in FIG. 2, showing the full cross section of the steering arrangement.
Figure 5:
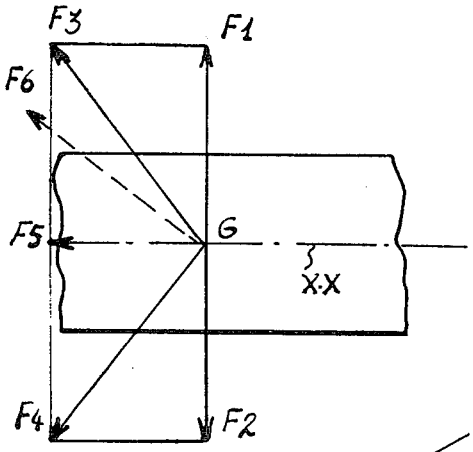
FIG. 5 is a diagram showing the directions of the gas jets which may be generated by the steering arrangement of FIGS. 1 to 4.

In the embodiment shown, the above-mentioned means are formed by a source of steering energy which is housed in the vicinity of the center of gravity G of the missile 1. To be more exact, the energy source of the steering arrangement 2 comprises two identical gas generators 4*a*, 4*b* which are positioned symmetrically on either side of the center of gravity G coaxially with the missile 1. The gas generators 4*a*, 4*b* communicate with one another and means are provided to switch or divert the gases to the exterior of the missile 1 in two directions which are symmetrical about its longitudinal axis XX. As can be seen in FIG. 5, these directions may be perpendicular to the axis XX (F1 and F2) or may be inclined to the axis, as is the case with directions F3 and F4. The corresponding forces (not shown) which are set up by reaction are in the opposite directions. However, it can be assumed that F1 is the force corresponding to the ejection of gases in the direction of arrow F1, and vice-versa.

The forces corresponding to F3 and F4 which are inclined in relation to XX have a component perpendicular to the axis, these components being F1 and F2, respectively, in the example shown in FIG. 5, and a component equal and opposite to F5 coaxial with the missile 1.

In the various cases shown, the directions of these thrusts converge on a single point situated on the axis XX which is formed by the center of gravity G.

The gas generators 4*a* and 4*b* are formed by two spaces containing solid propellant 5 which are connected together by two parallel longitudinal passages 6, while a nozzle throat 7 for the outflow of the combustion gases is arranged between the passages 6 in the wall of space 4*b* coaxially with the missile 1. The nozzle throat 7 communicates with two divergent ducts for expelling the gases through lateral orifices 8, from which the jets of gas are expelled in two directions which are symmetrical about the longitudinal axis XX, these jets being for example the jets of gas which are indicated by arrows F3, F4 in FIG. 5.

Figure 2:
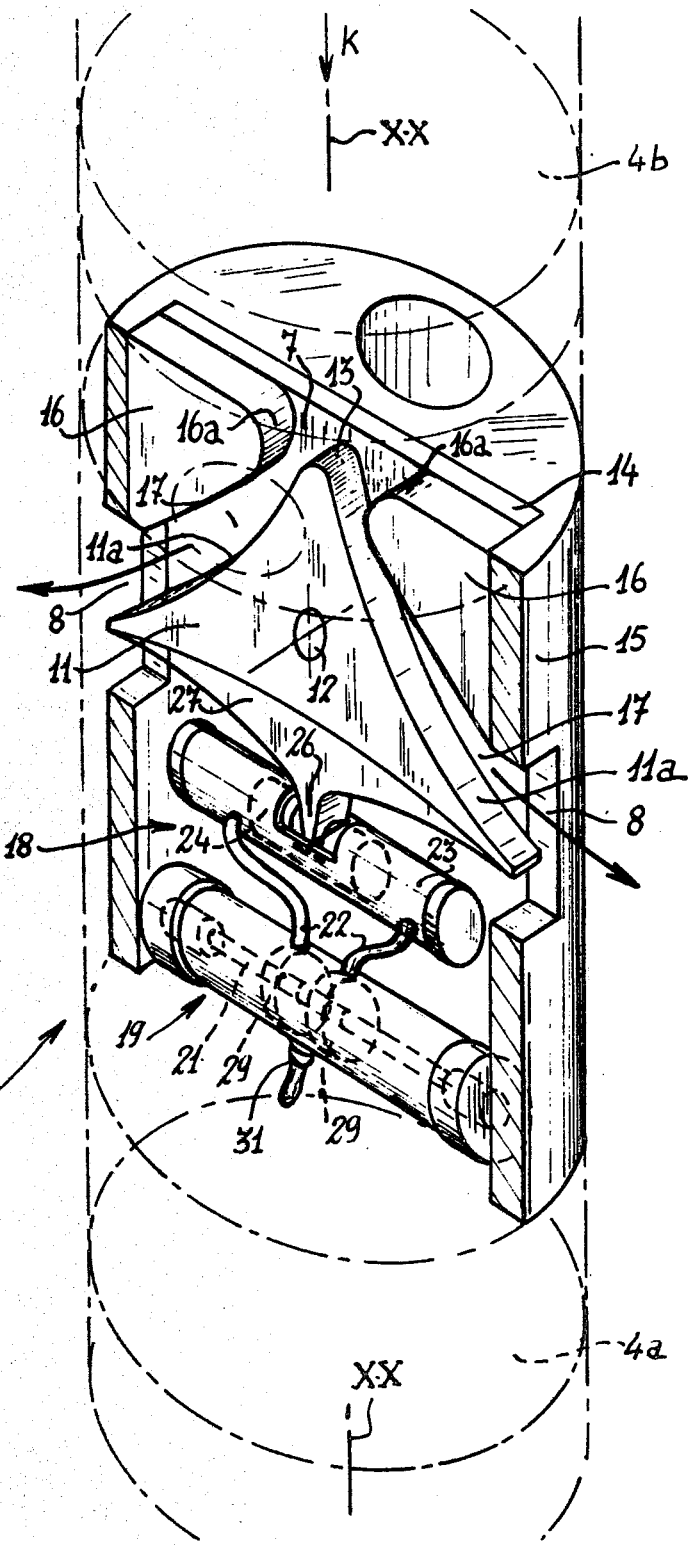
FIG. 2 is a partial elevational view to an enlarged scale on line II—II of FIG. 3 of a first embodiment of the steering arrangement according to the invention.
Figure 4:
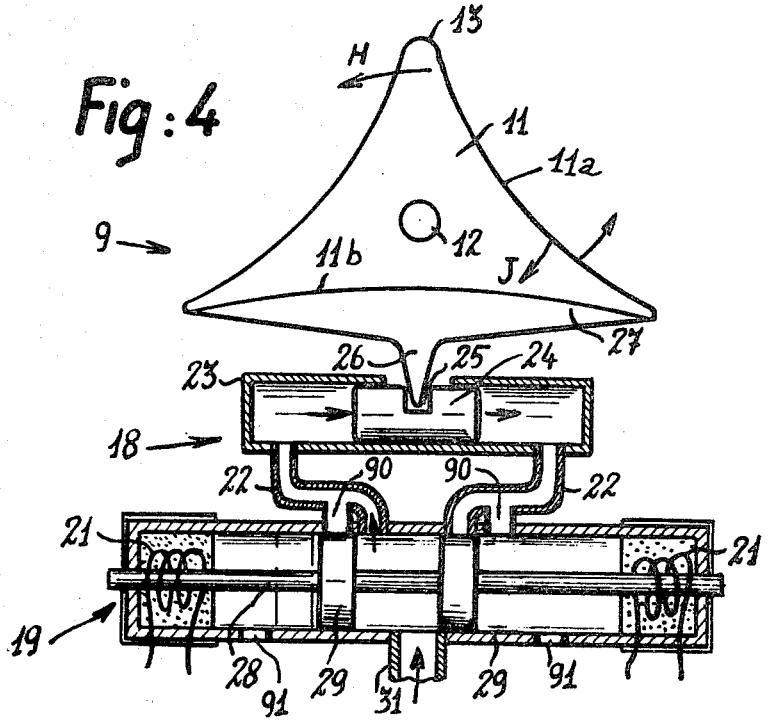
FIG. 4 is an elevation view, partly in cross section, of a first embodiment of the switching system and its associated control arrangement, both of which can be used in the steering arrangement shown in FIGS. 1 to 3.

In addition, a switching or diverting system 9 which can be seen in FIGS. 2 and 4 is mounted between the two spaces 4*a*, 4*b* to orientate the combustion gases in one or the other of the aforesaid directions. In the embodiment shown, the switching system 9 comprises a vane 11 which is mounted to rotate about a shaft 12 perpendicular to the longitudinal axis XX of the missile, this vane 11 being of approximately triangular outline and having a rounded apex 13 engaged in the nozzle throat 7. The latter is defined by two side-pieces 16 and by two plates 10 and 14 which are inset, in the body 15 of the missile parallel to axis XX, between the two longitudinal passages 6 which are arranged on either side of the axis XX of the missile. The side-pieces 16 are secured between the plates 10, 14 and the body 15 of the missile, and between their facing edges 16*a* they leave a gap to form the nozzle throat 7.

In conjunction with the corresponding sides of the vane 11, the sides of the side-pieces 16 which run from edges 16*a* and which are situated opposite the vane 11 define the divergent outflow ducts for the combustion gases coming from spaces 4*a* and 4*b*. To this end, the sides 11*a* running from the apex 13 are somewhat concave so that the cross-sectional area of the ducts increases from the throat 7 to the orifices 8, thus effectively forming divergent ducts 17. In the embodiment shown in the Figures, these divergent ducts 17 are inclined to the longitudinal axis XX to the missile, in such a way that the direction of the jets of gas which are able to escape from the ducts are inclined to the axis XX.

The vane 11 is associated with a control arrangement 18 which is able to cause it to swing to one side or the other about its shaft 12, to allow the gases coming from the nozzle throat 7 to be orientated into one or other divergent duct 17. In the embodiment which is shown in FIGS. 2 and 4, the arrangement 18 for controlling the swing of the vane 11 comprises a double-acting servo-valve 19 which is provided at its ends with two solenoids 21 which are connected to a double-acting cylinder 18. In its central region, the servo-valve 19, which may be pneumatic or hydraulic, communicates with two angled conduits 22 which open at opposite ends of a chamber 23 of elongated form in which a piston 24, which is connected to the vane 11 to control it, is able to reciprocate.

This piston 24 is formed by a slug which is able to perform reciprocating movements in chamber 23 as dictated by control pulses coming from one or the other of the solenoids 21—21, and the piston has a centrally disposed notch 25 in which is engaged a tongue 26 that is secured to a web 27 that is attached to the side 11*b* of the vane 11 and opposite from its apex 13.

In addition, the servo-valve 19 is provided, in a known fashion, with a longitudinal distribution rod 28 the ends of which are attached to the magnetic cores of the solenoids 21, which latter, when energized by an electrical current, are able to attract the rod 28 in one or the other direction. The rod 28 is provided in its central region with two symmetrical valve members 29 whose spacing is such that when they are moved in one or other direction after the energization of a solenoid 21, one or other of the conduits 22 is blocked and the unused part of the cylinder can be drained. The body of the servo-valve 19 is pierced with four exhaust apertures 90—90 and 91—91 the two apertures designated as 90 being arranged in the vicinity of the inlets to conduits 22 and opening into the latter, while the apertures 91—91 are arranged between the obturators or valve members 29 and the solenoids 21. Fluid is injected into the servo-valve 19 through a central duct 31 which opens between the valve members 29.

If one of the solenoids 21 is energized, for example, that on the left of FIG. 4, it attracts the rod 28 so that the valve member 29 opposite from the energized solenoid closes the associated conduit 22 while the other conduit 22 is opened. This creates an imbalance in the pressures at the two end faces of the piston 24, which moves accordingly and causes the vane 11 to pivot, via the tongue 26, as is indicated by the arrows shown in FIG. 4. At the same time, the fluid in the cylinder 18, which is forced back by the piston 24, flows out through those exhaust apertures 90,91 which are associated with the conduit 22 through which the fluid is forced out as shown by the arrows in FIG. 4.

In accordance with an important feature of the invention, means are provided to ensure that the forces which are applied by the combustion gases to the parts of the concave sides 11*a* close to the apex 13 and which tend to cause the rocker to pivot in one direction (for example that indicated by the arrow H shown in FIG. 4) are substantially equal to the opposing forces which are applied by the gases to the parts of the sides 11*a* farthest from the apex 13. Taking the right-hand side 11*a* of the vane 11 in FIG. 4, these latter forces do in fact tend to cause the vane to pivot about the shaft 12 in the direction indicated by arrow J, which is opposite to the direction of pivot indicated by arrow H.

To this end, it is possible, with advantage, to position the pivot shaft 12 in such a way that the area of the sides 11*a* situated between the level of shaft 12 (the vane 11 being assumed to be vertical and the shaft 12 horizontal) and that of the apex 13 is smaller than the area of the sides 11*a* situated below the level of shaft 12. The pressure of the gases is less in the parts of the divergent ducts 17 close to their orifices 8 than it is between the apex 13 and the level of shaft 12. It will be appreciated that if the latter is suitably positioned it is possible to achieve a virtual balance between the opposing forces which are generated by the gases against the sides 11*a* of the vane 11 and which tend to turn it in opposite directions.

As a result of this, even if a complete balance is not achieved, it is merely necessary to give the member for controlling the vane 11 a small impetus to cause the vane to rock to one or other of its two possible positions against the side pieces 16, thus channeling the gases accordingly into one or the other of the two divergent ducts 17.

The operation and advantages of the steering arrangement which has just been described are as follows:

After the missile 1 has been launched, the propellant masses 5 in spaces 4*a* and 4*b* are ignited in a known fashion so that combustion gases coming from space 4*a* will travel along the longitudinal passages 6 and mix with gases resulting from the combustion of the propellant in space 4*b*, the mixture of gases then flowing out through the nozzle throat 7. This flow of the combustion gases is indicated by the arrows shown in FIG. 1.

To orientate the combustion gases in one or other of the two possible directions, it is merely necessary for the switching vane 11 to pivot about its shaft 12 in such a way that its apex 13 comes into abutment against the edge 16*a* of one or other of the side pieces 16. The divergent duct 17 corresponding to the side piece 16 in contact with the vane 11 is then blocked and as a result the gases must travel along the duct 17 which is left open to be expelled to the exterior of the missile through the corresponding opening.

To set the vane 11 to one or other of its two possible positions, its control arrangement 18 is actuated by energizing the appropriate solenoid 21 for the desired position of the vane 11.

The transverse force so generated (for example F1, F2 or the force opposed to F3) is applied to the center of gravity of the missile 1, whose trajectory is altered accordingly by the acceleration imparted to the missile as long as the force is maintained. This change of trajectory does not entail any significant alteration to the angle of incidence of the missile owing to the fact that the force which causes it is applied precisely to the center of gravity G, which constitutes a very important advantage as compared with known steering arrangements.

The inclination of the jets of gas to the axis of the nozzle throat 7 (which preferably coincides with the longitudinal axis XX of the missile) after switching, may vary widely between a direction perpendicular to this axis, such as F1 or F2 (FIG. 5), and a more or less slight inclination to the axis concerned, such as that corresponding to the arrow F6 shown as a broken line in FIG. 5.

To produce jets of gas having different orientations relative to the axis of the nozzle throat 7, it is necessary to adapt the configuration of the divergent expulsion ducts to the inclination which the jets of gas are required to have.

When the jets are inclined to the axis of the nozzle throat 7 and to the axis of the missile, they have an axial component which may, with advantage, create a longitudinal thrust.

It is equally advantageous in all cases to cause the forces produced to radiate from a point situated on the axis XX on the missile, this point being the center of gravity G in the embodiment being described.

The transverse force resulting from the combustion of the propellants 5 is maintained for as long as the propellants burn. Thus, if it is desired to cancel out the transverse force so created at a given moment, one means is to cause the vane 11 to oscillate on its shaft 12 at very short intervals, in such a way as to deflect the jet of gas into alternate ones of the divergent ducts 17. The resultant of the two forces which occur in opposite directions is zero. The missile thus remains on its new trajectory for as long as the oscillation of the switching or changeover vane 11 is maintained.

The fact of arranging the two propellant spaces 4*a* and 4*b* symmetrically about the center of gravity G of the missile has a specific advantage: in effect, the combustion of the propellants is identical on either side of the center of gravity G, and thus the reduction in the mass of the propellants is the same in both these spaces and consequently does not alter the position of the center of gravity G. Thus, the balance of the missile is maintained during the whole of the period when the propellant masses 5 are burning.

The fact of positioning the pivot shaft 12 of the vane 11 in the manner indicated above, that is to say in such a way that the opposing forces which are applied by the gases to the vane 11 and which tend to cause it to pivot in opposite directions are substantially equal, is extremely advantageous in comparison with known systems, in particular those which use needle valves. In effect, an impetus of small amplitude is all that is needed to cause the vane 11 to pivot to the required position, which is achieved by means of a control arrangement such as the arrangement 18 or that shown in FIG. 6.

The relative geometry of the nozzle throat 7 and the apex 13 of the vane 11 is advantageously calculated in such a way that the flow of gases through the nozzle throat remains constant no matter what the movement of the vane 11. In effect, the cross-sectional area which is left open in the nozzle throat 7 for the exit of the gases remains constant whatever the position of the vane 11, which avoids the harmful vibrations which would be caused by a variation in pressure.

Another advantage of the steering arrangement according to the invention derives from the fact that it does not require sealing glands to be fitted to the pivot shaft 12 for the vane. This shaft, being engaged in plate 14 and held captive between it and plate 10, is wholly situated in the zone where exchanges of pressure take place, without any need for it to be accessible.

The position of the switching vane 11 may be controllable either discontinuously or continuously, the gas jets being divided, in the second case, in proportion to the angle to which the vane 11 pivots between the side pieces 16 by a conventional servo-control process. The gases are then expelled simultaneously through the openings 8 of both the divergent ducts 17. If the head or apex 13 of the vane is situated at equal distances from the edges of the side pieces 16, the jets of gas are equal and produce two equal transverse forces in opposite directions, the resultant of which is thus zero. The missile thus maintains its trajectory as long as the gas jets remain equal.

Figure 6:
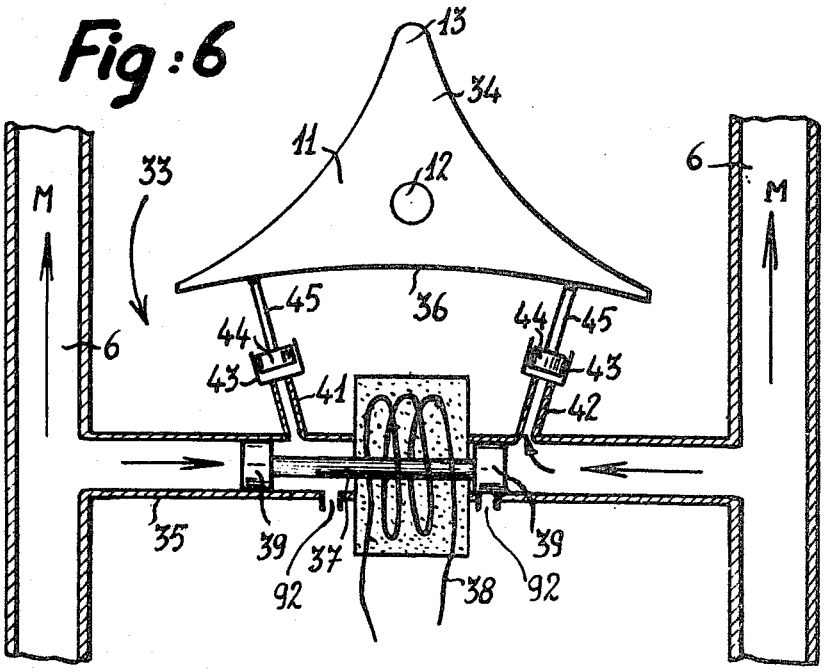
FIG. 6 is a view similar to FIG. 4 of a second possible embodiment of a switching system and its control arrangement which may be used in the steering arrangement of FIGS. 1 to 3.
Figure 8:
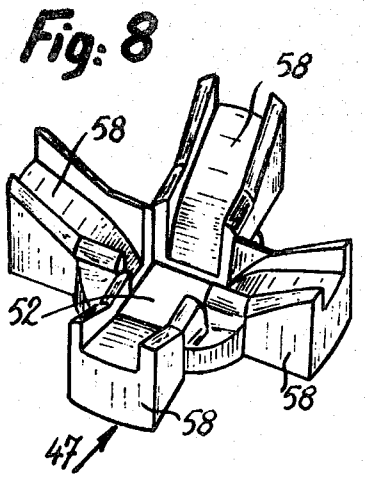
FIG. 8 is a perspective view of a fixed part associated with the vane of FIG. 7, which defines the corresponding nozzle throat.

In the embodiment which is shown in FIG. 6, the arrangement 33 for controlling the swing of the vane 34 comprises a transverse passage 35 which is associated with means for directing the gases contained in it to alternate ends of that side 36 of the vane 34 which is opposite from its apex or head 13.

In the embodiment which is shown, these means comprise a slider or shaft 37 which is able to reciprocate in the central part of passage 35 under the prompting of a control solenoid 38. The slider 37 is formed by a metal rod which passes through the solenoid 38 and which is provided with two cylindrical piston elements 39–39 at the ends. The size of the piston elements is such as to enable them to block the inlet to one or other of two ducts 41 and 42 alternately, these ducts communicating with the transverse passage 35 and each leading to a cylinder 43.

The cylinder 43 contains a piston 44 which is provided with a shaft member 45 which is capable of applying force to the associated end of side 36 of the vane 34 to cause the latter to pivot in the desired direction about its shaft 12. The combination of piston 44 and shaft member 45 is preferably combined with a ball joint which enables the end of shaft member 45 to maintain contact with side 36 while the vane 34 is pivoting. Two orifices 92—92 arranged on either side of the solenoid 38 in passage 35 allow the gases to escape.

Thus, this system enables advantage to be taken of the power which is available from the gases under pressure which flow through the conduits 6 from space 4*a* toward space 4*b* (arrows M).

The pressure exerted by the gases on the two piston elements 39 is equal, and so, when solenoid 38 is not energized, no other force is applied to slider 37 and the vane 34 is in its central equilibrium position. When the solenoid 38 is energized, the rod 37 moves in one or other direction and as a result one of the piston elements 39 opens the inlet to the associated duct 41 or 42. As a result, the pressure of the gases which enter the duct concerned pushes against the piston 43, whose shaft member 45 then causes the vane 34 to pivot, while the gases which are forced back by the other piston 43 escape through pipe 41 and the corresponding exhaust aperture 92.

The control arrangement 33 has the advantage of making direct use of the power of the combustion gases to bring about the pivoting movement of the vane 34.

In the embodiment which is shown n FIGS. 7 to 13, the steering arrangement according to the invention is provided with means for switching the gases to the outside of the missile which comprise ducts which are orientated in four separate directions situated in two mutually perpendicular planes one of which contains the axis of the missile.

The switching system which, as a whole, is shown in FIGS. 7 to 12, includes a movable vane 46 which cooperates with a fixed complementary part 47 secured to the body of the missile. The vane 46 is formed by a truncated pyramid 48 which is provided at the four sides of its base with four identical arms 49 which are inclined at equal angles to the axis YY of the truncated pyramid 48 (FIG. 9) and which are spaced apart at angles of 90°. The vane 46 is so formed as to have a plane of symmetry, which thus contains the axis of the truncated pyramid 48, the end face 51 of the truncated pyramid preferably being slightly domed and the pyramid being engaged in a nozzle throat 52 formed within the fixed part 47.

Figure 12:
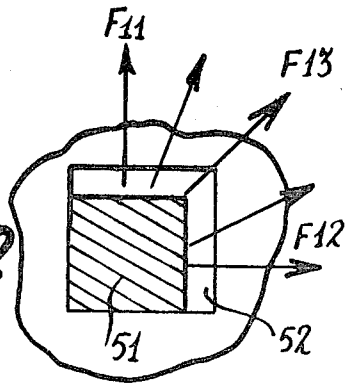
FIG. 12 is an elevation view of the nozzle throat showing the directions in which the gases are exhausted when the vane is in the position shown in FIGS. 10 and 11.

In the embodiment being described, the outline shapes of the head of the truncated pyramid 48 and the associated nozzle throat 52 are square, as can be seen in FIG. 12, and their relative dimensions are such that the flow of gas remains constant whatever the position of the truncated pyramide 48.

Figure 9:
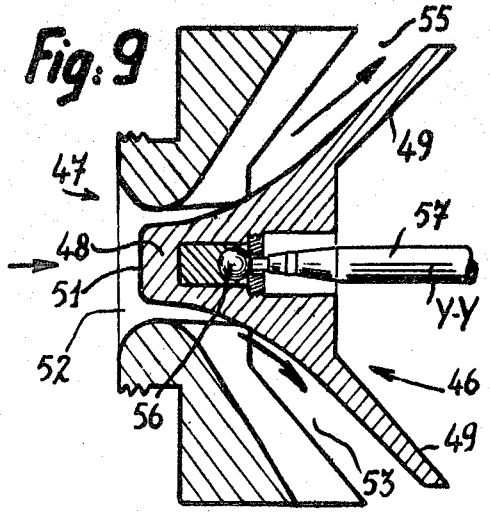
FIG. 9 is a view in axial section of the fixed part and the vane of FIGS. 7 and 8, showing the vane engaged in the fixed part.
Figure 10:
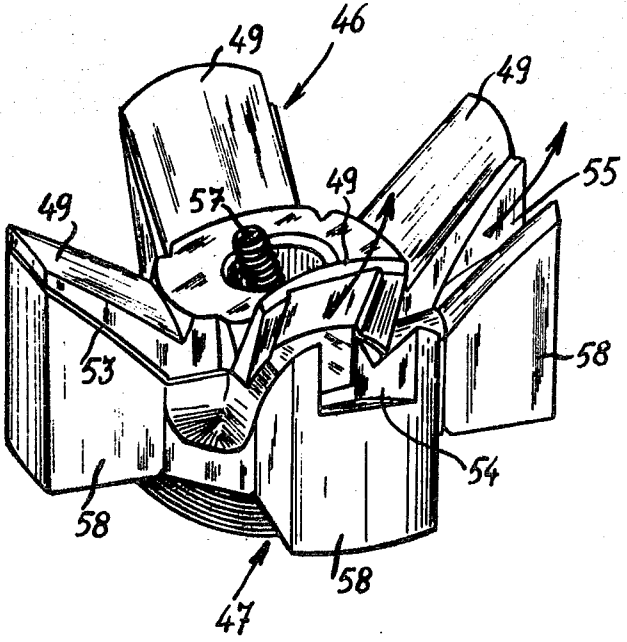
FIG. 10 is a perspective view of the assembled vane and the fixed part of FIGS. 7 to 9, the vane being positioned in such a way that the gases are able to flow out in two of the four above-mentioned directions.
Figure 11:
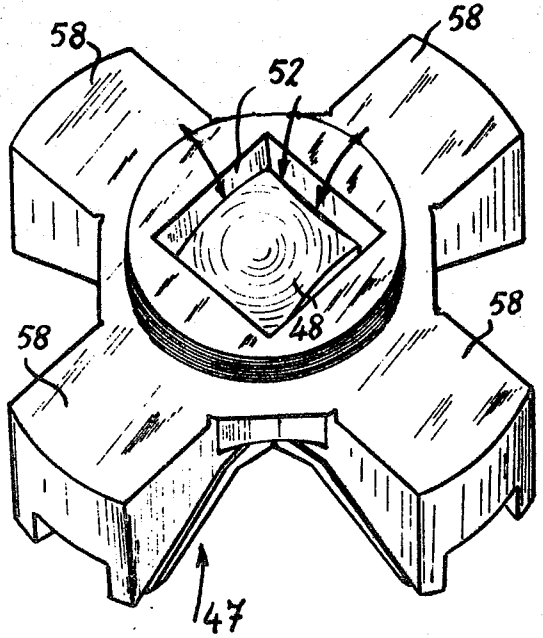
FIG. 11 is a perspective view of the assembly of FIG. 10, looking from the nozzle throat side.

The fixed part 47 is formed in such a way to define, in conjunction with the vane 46, four divergent ducts corresponding to the four arms 49, three of which (53, 54 and 55) can be seen in FIG. 10. The directions of these four ducts for the expulsion of gases correspond very approximately to the directions indicated by arrows F7 and F10 in FIG. 13, which correspond to the axes of the four above-mentioned divergent ducts. Means are also provided to control the rocking movement of the vane 46 about a point contained within it, which takes the physical form of the ball 56 of a ball joint (FIG. 9), to enable the gases to be expelled selectively through at least some of the divergent ducts of the arrangement.

When assembled, the vane 46 and the fixed part 47 form the nozzle proper of the steering arrangement.

The ball 56 is attached, on the axis of the nozzle throat 52 and on the axis of the missile, to a supporting shaft 57 which is coaxial with the missile.

Figure 7:
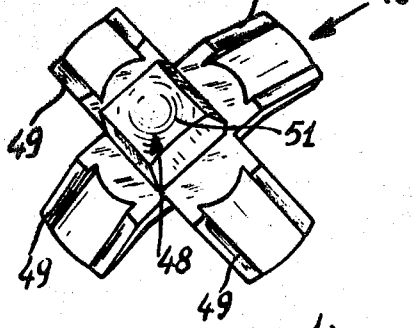
FIG. 7 is a perspective view of a second embodiment of a vane for the gas switching system which is arranged to enable it to direct the gases in four mutually perpendicular directions which pass through one and the same point situated on the longitudinal axis of the missile.

In accordance with the feature of this embodiment, each arm 49 is trough-shaped in cross section, as can be seen in FIG. 7 in particular, and is adapted to be capable of association with a corresponding hollow arm 58 of the fixed part 47, these arms 58 being of a similar trough-shaped or U-shaped cross section complementary to the cross section of arms 49. When the arms 49 and 58 are brought together facing one another, it is possible to form as many divergent ducts for the gases as each of the parts 46 and 47 has arms, that is to say, four. The nozzle throat 52 is arranged at the center of part 47, that is to say, in the area where the four arms 58 meet. Thus, the vane 46 forms a sort of male half-shell which is inserted in the fixed part 47 which forms a female half-shell.

This optimized configuration ensures that the system is very well sealed, to prevent any leakage into two of the ducts when the other two have gases flowing through them.

The way in which the nozzle and the switching system shown in FIGS. 7 to 12 operate is as follows:

The vane 46 is controlled to rock about the fixed ball 56 by means of a known mechanical, electrical, pneumatic or other arrangement which is connected to the servo-control system of the missile. Thus, the vane 46 can be caused to rock in such a way that adjoining sides of the end face 51 of the truncated pyramid 48 come to rest against two corresponding adjoining sides of the square nozzle throat 52, as shown in FIG. 12. This position is also close to that seen in FIG. 11, where the truncated pyramid 48 is almost in contact with two of the sides of the nozzle throat 52. Under these conditions, when the propellants in the propellant spaces are ignited, the combustion gases flow out through the divergent ducts left open by the vane 46, that is to say, through divergent ducts 54 and 55 in the case illustrated in FIG. 10.

The gases are thus expelled from the missile in two directions lying in two manually perpendicular planes (arrows F11 and F12 in FIG. 12). The flow of gases in these two directions are substantially equal and their resultant F13 is represented by a diagonal of the square whose sides are F11 and F12. By reaction, the missile is thus moved in the opposite direction from the resultant F13. If it is desired to steady the missile on its new trajectory, it is merely necessary for the system controlling the rocking of the vane 14 to bring the latter to a central position where it leaves access open to all four divergent ducts, as shown in FIG. 9. The gases are then able to flow out simultaneously through all the four divergent ducts defined by the pairs of arms 49, 58 and at equal rates of flow, so that the resultant of the four thrusts produced is zero.

Figure 13:
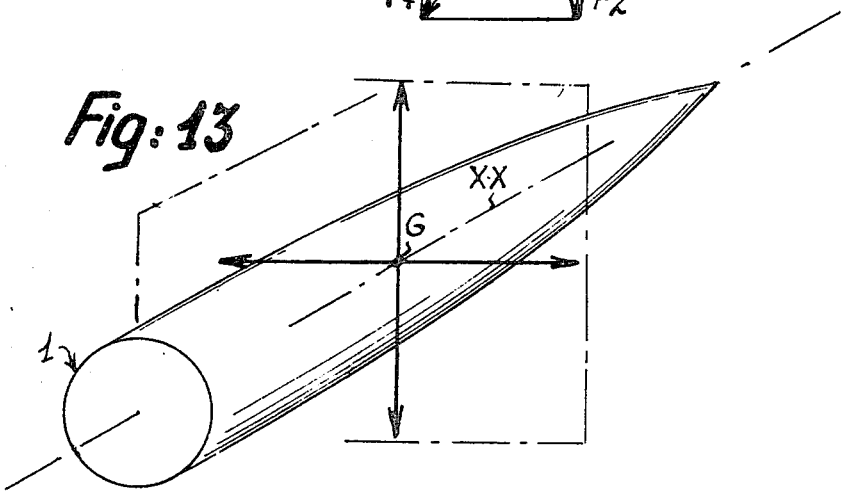
FIG. 13 is a diagram showing various possible directions for the jets of gas in the case of the embodiment of FIGS. 7 to 12.

It is, of course, possible to form the divergent gas-expulsion ducts in such a way that the gases are expelled in four directions which form a cross, perpendicular to the axis of the missile 1, as is shown by the arrows appearing in FIG. 13 (see sheet 1). The axial component of each of these four thrusts is thus zero.

Figure 15:
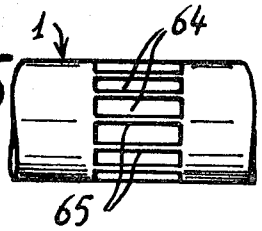
FIG. 15 is a simplified elevation view showing the periphery of the projectile at the point where the gas expulsion ducts are situated, as adapted for the modified vane shown in FIG. 14 to allow the gases to be exhausted around the whole of the periphery of the projectile.
Figure 16:
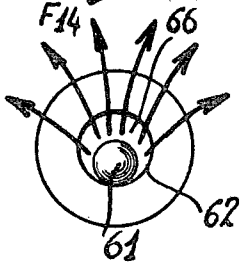
FIG. 16 is a view similar to FIG. 12 showing the vane pressed against the wall of the nozzle throat to channel the gases in the directions which remain open.
Figure 14:
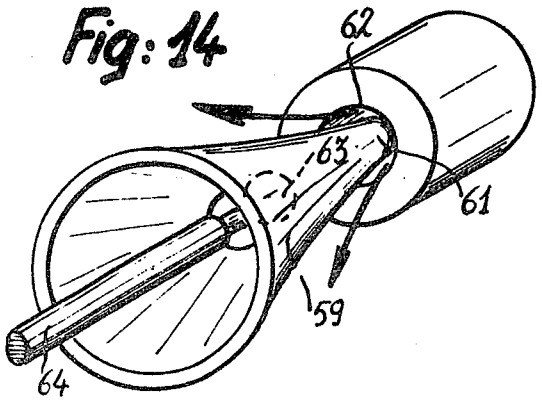
FIG. 14 is a perspective view of a third embodiment of the switching vane of the arrangement according to the invention, this vane being produced in such a way that the gases form a body-of-revolution layer around the longitudinal axis of the projectile.

The modified embodiment shown in FIGS. 14 to 16 is a switching system which has a vane 59 of cone-like configuration which is coaxial with the missile in its central position and whose rounded apex 61 is engaged in a corresponding circular nozzle throat 62.

The vane 59 is hollow and is mounted to pivot about a point contained within the cone which takes the physical form of the ball 63 of a ball joint which is attached to an axial support 64 in a similar way to ball 56. Control means of the same kind as are provided for vane 56 may be used to cause the conical vane 59 to rock about the ball 63.

When the head 61 of the vane 59 is held in a centralized position in the middle of the circular throat of nozzle 62, as is shown in FIG. 14, the gases flow out around the whole of the vane, forming a body-of-revolution layer coaxial with the missile. To enable the gases to be expelled virtually uninterruptedly around the entire periphery of the missile, the part of the missile adjoining the base of the vane 59 is cut away, the shell or body of the missile thus having an annular interruption 64. Connecting ribs 65 of adequate strength provide a connection between the two parts of the missile 1.

If the vane 59 is caused to rock about the ball 63 to move it to the edge of the nozzle throat 62, for example to the position shown in FIG. 16, the combustion gases flow out preferentially in a sort of crescent 66. The throughput of gas varies from one end of this crescent to the other, being greatest in the region where the gap between the edge of the nozzle throat 62 and the periphery of the head 61 is largest. Only a very small amount of gas flows on either side of the line of contact between the head 61 and the nozzle throat 62. The resultant thrust thus passes through the zone where the gap between the edge of the nozzle throat and the head 62 is greatest, this resultant thus being in the opposite direction from arrow F14. By causing the vane 59 to pivot continuously about the ball 63, an orientatable body-of-revolution layer of gas can thus be produced.

The vane 59, and the other possible embodiments of the vane, may be continuously controlled by means of two intersecting sensors for sensing the position of the vane (two potentiometers for example), which are associated in a known fashion with a servo-control member connected to an actuating motor.

Figure 17:
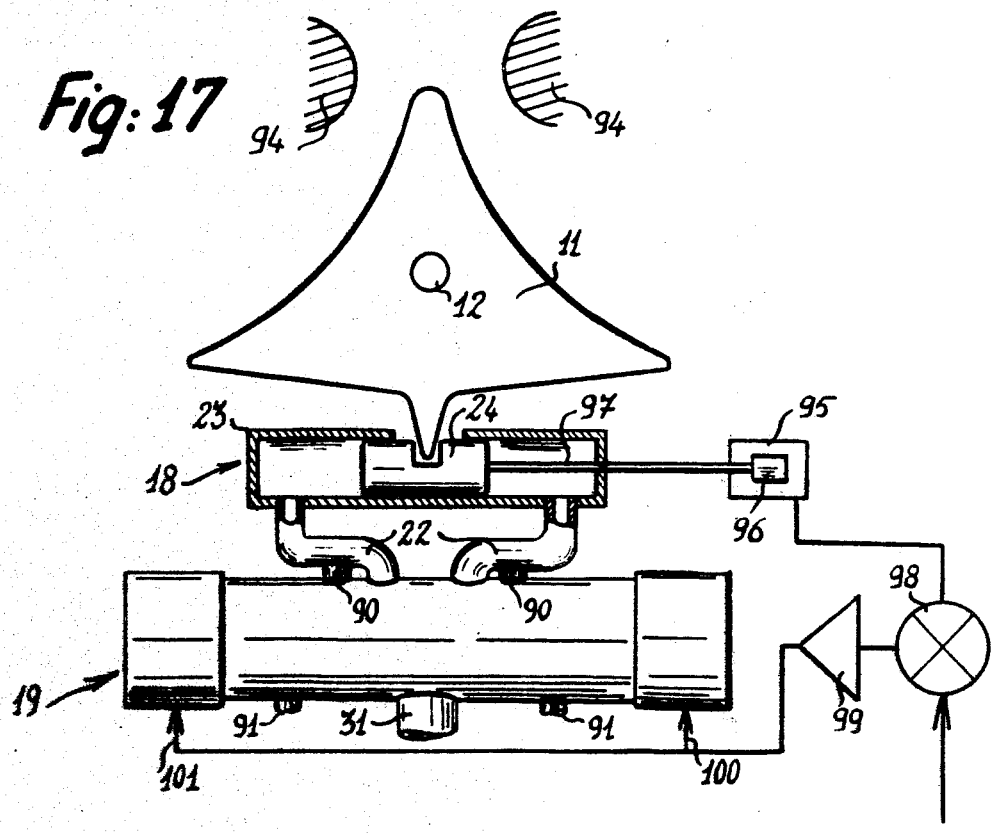
FIG. 17 shows a modification of the control arrangement shown in FIG. 4.

FIG. 17 shows a modification of the arrangement of FIG. 4, in which the vane 11 is servo-controlled by means of two position sensors 94 placed close to the vane 11.

The sensors are connected, by means which are not shown, to a member 95 which contains a piston 96 which is secured to the piston 24 by a rod 97, this member 95 being connected to a comparator 98. The latter is in turn connected on the one hand to a system (not shown) for the electrical control of the position of the vane 11, and on the other hand to the two control solenoids 21 of the servo-valve 19 via an intervening amplifier 99 (connections 100 and 101).

The system for controlling the position of the vane 16 thus transmits electrical pulses to one or the other of the solenoids of the servo-valve 19, via the amplifier 99, as dictated by the result of a comparison between the signals received by the comparator 98. The position of the vane 16 is thus slaved to the control system of the missile.

In addition to the advantages already mentioned, all the embodiments described above have the advantage of enabling control surfaces for the missile to be totally dispensed with. The manufacture of the missile is thereby simplified, which makes it substantially less expensive. Furthermore, the fact of being able virtually to eliminate the delay or time-constant which occurred in embodiments known hitherto between the order and its actual execution, allows a considerable improvement to be made in the effectiveness with which the missile is steered. As a result, it is possible to improve firing accuracy to a very appreciable extent.

The invention is not restricted to the various embodiments described and may be modified in many ways, both for the application described and for other possible applications. Thus, the steering arrangement may be installed at a point remote from the center of gravity of the missile, for example at the front of the missile. When this is the case, the actuation of the arrangement results in a change in the angle of incidence of the missile on its trajectory, which may be desirable in certain cases, for example to avoid deploying control surfaces such as those of the canard type on the outside of the missile, thus affording the advantage that the aerodynamic shape of the missile is preserved.

It is also possible to use gas generators, other than spaces containing solid propellants, such as tanks of compressed gas for example. Another modification which is also possible is to balance a vane which switches the gases into only two divergent ducts, like the vane 11 of FIG. 2, consists in increasing the thickness of the sides of the vane from its apex to the openings of the divergent ducts. However, this solution is more difficult to implement from the technical point of view than that which consists in placing the axis of rotation in a suitable position to balance the opposing forces. It is also possible to provide only one, or a plurality of, connecting passages between the propellant spaces or, in more general terms, between the two gas generators.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A piloting arrangement for a guided missile having a body comprising, in combination, two gas generators in said missile body for providing a source of gas flow, said two gas generators being coupled in parallel and disposed symmetrically at either side of the center of gravity of said missile body, a nozzle having a throat disposed between said two gas generators coaxially with the longitudinal axis of said missile, conduit means in said missile for conducting said gas flow from said gas generators to said nozzle throat, a plurality of peripheral ejection openings in said missile body localized in the vicinity of a plane perpendicular to the longitudinal axis of said missile body containing the center of gravity of said missile, a plurality of divergent conduits in said missile body for connecting said nozzle to said peripheral ejection openings, said divergent conduits having a curvature whereby the lateral force resulting from the flow of gas through said ejection openings passes effectively through the center of gravity of said missile, a pivotally mounted mounted blade having sides disposed partially in the neck of said nozzle, said blade sides forming part of the walls of said divergent conduits and means for pivoting said blade into a selected position for controlling the distribution of said gas flow through said divergent conduits and said ejection openings.

2. A piloting arrangement in accordance with claim 1 wherein said two gas generators are substantially alike, said two gas generators being disposed coaxially with the longitudinal axis of said missile body and at an equal distance from the center of gravity of said missile body.

3. A piloting arrangement in accordance with claim 1 wherein said conduit means include a plurality of longitudinal conduits disposed around said nozzle for coupling said two gas generators in parallel.

4. A piloting arrangement in accordance with claim 1 wherein said two gas generators each include a combustion chamber and a solid propellant in each of said combustion chambers.

5. A piloting arrangement in accordance with claim 1 wherein said plurality of peripheral ejection openings includes two ejection openings diametrically opposed to one another and wherein said nozzle includes side walls partially defining said divergent conduits, and wherein said pivotally mounted blade is arranged to pivot about an axis perpendicular to the longitudinal axis of said missile body, said blade having a substantially triangular contour with a top partially disposed in the neck of said nozzle, said blade extending from said blade top to define with said nozzle said divergent conduits, said blade pivoting means being arranged to rock said blade laterally in either direction so as to divide said gas flow in either one or the other of said two ejection openings.

6. A piloting arrangement in accordance with claim 5 wherein said blade sides having a profile leading from the top disposed in said nozzle neck so that the forces resulting from the passage of the flow of gas on said blade adjacent to said top, and which tend to make said blade pivot laterally in one direction are effectively equal to the opposing forces resulting from the passage of the flow of gas on said blade opposite to said top and which tend to make said blade pivot in the opposite direction, and wherein the axis on which said blade is pivoted is positioned so as to contribute to the cancellation of said pivot forces on said blade.

7. A piloting arrangement in accordance with claim 5 including a source of energy in said missile body for actuating said blade pivoting means, said source of energy comprising said gas generators.

* * * * *